United States Patent [19]

Voss

[11] Patent Number: 4,616,691

[45] Date of Patent: Oct. 14, 1986

[54] COUNTERGRAVITY CASTING APPARATUS

[75] Inventor: Karl D. Voss, Standish, Mich.

[73] Assignee: General Motors Corporation, Detroit, Mich.

[21] Appl. No.: 806,618

[22] Filed: Dec. 9, 1985

[51] Int. Cl.[4] ..... B22D 18/06

[52] U.S. Cl. ..... 164/255; 164/63; 164/256

[58] Field of Search ..... 164/255, 254, 256, 63, 164/65

[56] References Cited

U.S. PATENT DOCUMENTS 2,997,756 8/1961 Strom ..... 164/256 X
4,340,108 7/1982 Chandley et al. ..... 164/63
4,508,157 4/1985 Belliveau et al. ..... 164/63

FOREIGN PATENT DOCUMENTS 1433413 8/1970 Fed. Rep. of Germany ..... 164/254

*Primary Examiner*—Nicholas P. Godici
*Assistant Examiner*—J. Reed Batten, Jr.
*Attorney, Agent, or Firm*—Lawrence B. Plant

[57] ABSTRACT

Apparatus for the vacuum countergravity casting of metal including an elastomeric sealing gasket substantially thermally insulated, conduction-wise, from the underlying melt's heat by the mold-forming material and shielded from the melt's radiant heat by a surrounding skirt depending from the vacuum box.

3 Claims, 3 Drawing Figures

COUNTERGRAVITY CASTING APPARATUS

This invention relates to apparatus for the vacuum countergravity casting of metal in gas-permeable, shell molds and, more particularly, to means for sealing a mold to a vacuum chamber.

BACKGROUND OF THE INVENTION

The vacuum countergravity, shell mold casting process is particularly useful in the making of thin-walled castings and involves: sealing a bottom-gated mold, having a gas-permeable upper portion, to the mouth of a vacuum chamber such that the chamber confronts the upper portion; immersing the underside of the mold in an underlying melt; and evacuating the chamber to draw melt up into the mold through one or more of the gates in the underside thereof. Such a process is shown in U.S. Pat. No. 4,340,108 wherein the mold comprises a resin-bonded-sand shell having an upper cope portion and a lower drag portion sealingly bonded together. U.S. Pat. No. 4,340,108 seals the mold to the vacuum chamber atop the cope such that the parting line between the mold halves lies outside the vacuum chamber. Copending U.S. patent application Ser. No. 654,404 filed Sept. 26, 1984 in the name of Roger Almond, and assigned to the assignee of the present invention, seals the mold to the vacuum chamber atop the drag such that the parting line between the cope and drag falls within the vacuum chamber. In such processes, and particularly that shown in Ser. No. 654,404, the gasket material used to seal the vacuum chamber to the mold is necessarily brought into close proximity to the surface of the underlying melt during casting. Hence the gasket material is exposed to the tremendous heat that radiates from the melt pot. As a result, only highly temperature resistant gasket materials, such as Fiberfrax, (from the Carborundum Co.) or the like, has been used, heretofore. In this regard, Fiberfrax strips are typically glued to the surface of the mold and the mouth of the vacuum chamber pressed firmly against the material to compress it and form the desired mold-chamber seal. When so applied and used extra time is required to manually affix the gaskets to each mold and the gasket material is ultimately destroyed with the mold following casting. It would be desirable if an elastomeric gasket material could be affixed to the mouth of vacuum chamber for repeated use with many molds. This would eliminate the time required to manually prepare each mold-chamber seal as well as the unnecessary consumption of gasket material. Unfortunately, elastomeric gasket materials cannot survive the kind of direct exposure to the radiant heat from the molten metal that the Fiberfrax seals have had to endure.

It is an object of the present invention to provide improved apparatus for the vacuum countergravity casting of shell molds wherein the vacuum chamber is sealed to the mold at a site which is substantially thermally insulated (i.e., conduction-wise) and shielded (i.e., radiation-wise) from the surface of the metal melt during casting so as to permit the repeated use of a thermally degradable elastomeric gasket at the site. This and other objects and advantages of the present invention will become more readily apparent from the detailed description thereof which follows.

BRIEF DESCRIPTION OF THE INVENTION

The invention comprehends an improved vacuum countergravity casting apparatus including: a mold having a porous, gas-permeable upper shell and a bottom-gated lower portion secured to the upper shell; a sealing surface atop the mold which is substantially insulated conduction-wise, from the heat of the metal in the underlying melt pot; a vacuum box comprising a peripheral wall defining a vacuum chamber having a lip on the underside thereof defining the chamber's mouth; an elastomeric gasket compressed between the underside of the lip and the sealing surface of the mold; and a skirt depending from the wall beneath the lip so as to surround the gasket and the sealing surface sufficiently to shield the gasket from heat radiating from the pot. The sealing surface on the mold may be formed on top of the upper shell. Preferably, however, the lower portion of the mold will include a continuous upstanding ridge lying outboard the upper shell and adjacent the periphery of the mold, which ridge has the mold's sealing surface formed on the top thereof. The thickness of the mold-forming material (e.g., resin-bonded-sand) between the gasket and the melt serves to insulate the surface, conduction-wise, from the pot's heat.

BRIEF DESCRIPTION OF THE DRAWINGS

The invention may better be understood when considered in the light of the following detailed description of one specific embodiment thereof which is given hereafter in conjunction with the several drawings wherein.

DETAILED DESCRIPTION OF THE PREFERRED EMBODIMENT

Figure 1:
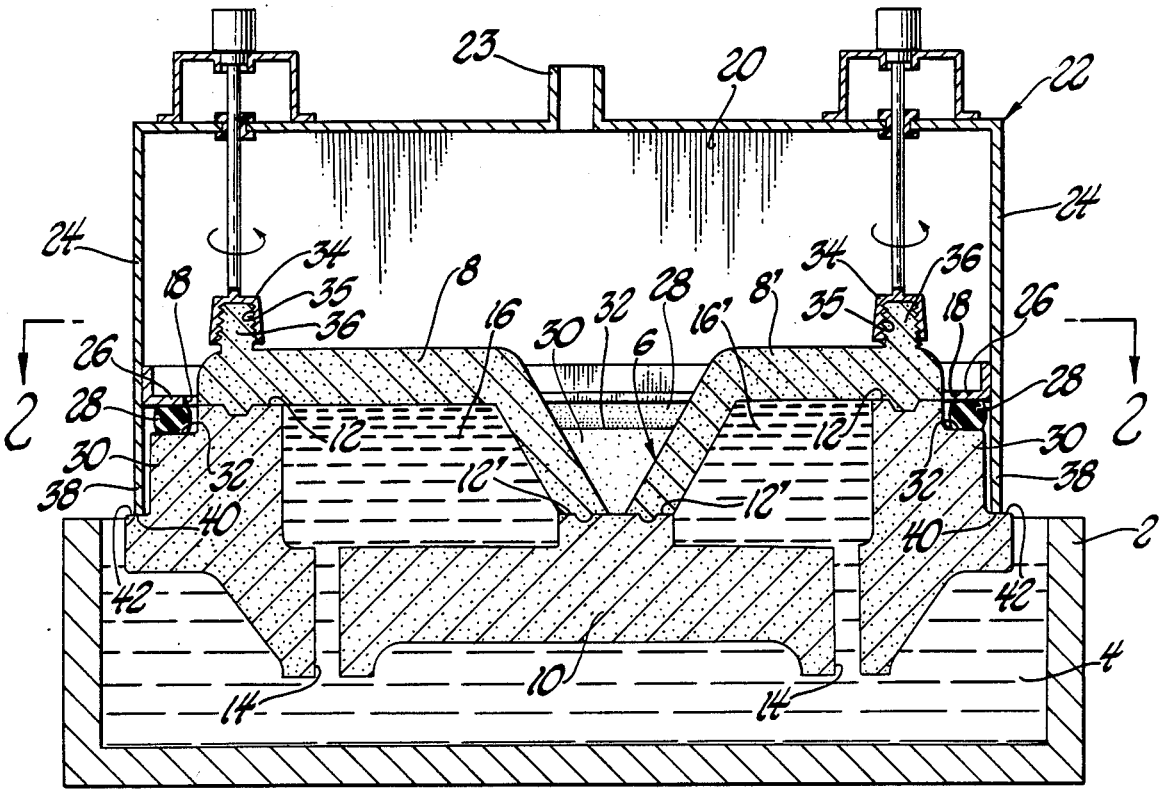
FIG. 1 is a side, sectioned view (i.e., in direction 1—1 of FIG. 2) through a vacuum countergravity metal casting apparatus in accordance with the present invention.
Figure 2:
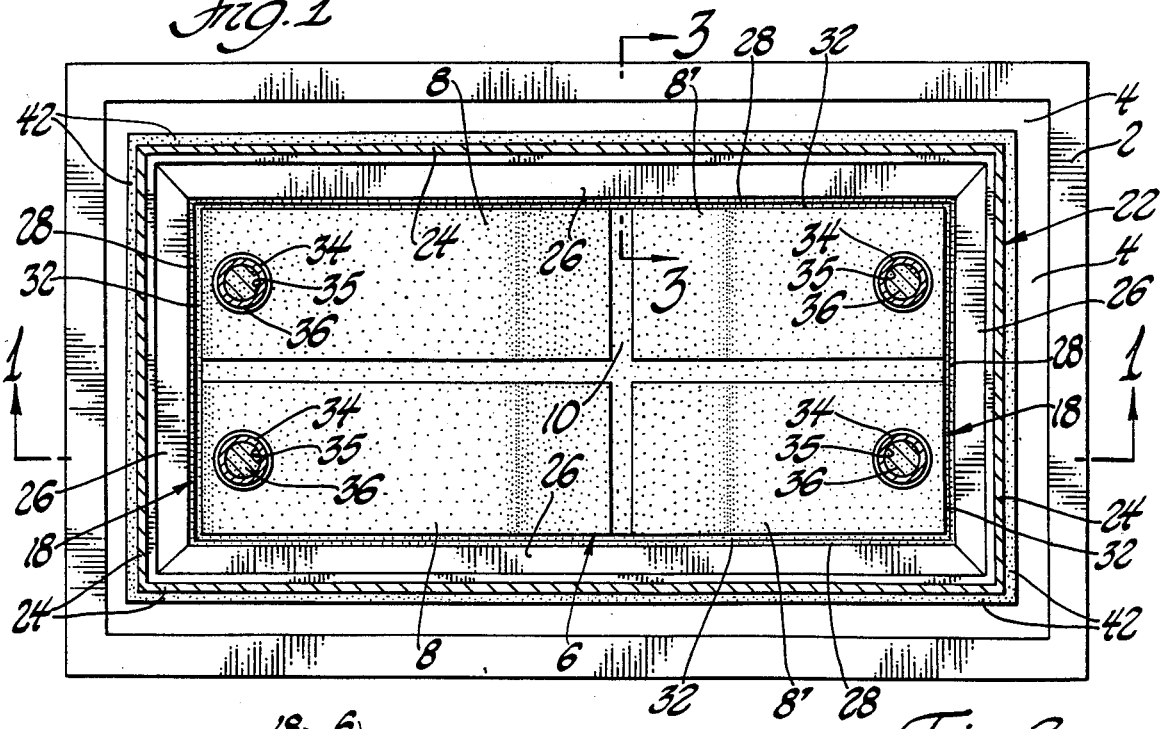
FIG. 2 is a view in the direction 2—2 of FIG. 1.
Figure 3:
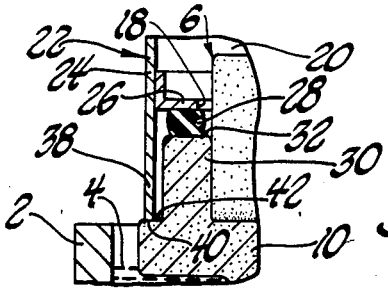
FIG. 3 is a view in the direction 3—3 of FIG. 2.

FIG. 1 shows a pot 2 of metal melt 4 which is to be drawn up into the mold 6. The mold 6 includes gas-permeable, upper portions 8 and 8′ joined (e.g., glued) to a lower portion 10 along parting lines 12 and 12′ and define therebetween separate molding cavities 16 and 16′. The lower portion 10 includes a plurality of ingates 14 on the underside thereof for supplying melt to the mold cavities 16 and 16′ when the cavities are evacuated. The lower portion 10 of the mold 6 is sealed to the mouth 18 of a vacuum chamber 20, which is defined by vacuum box 22, such that the gas-permeable upper portions 8 and 8′, are encompassed by the chamber 20. The vacuum chamber 20 is communicated to a vacuum source (not shown) via conduit 23. The upper portions 8 and 8′ of the mold 6 comprise a gas-permeable material (e.g., resin-bonded-sand) which permits gases to be withdrawn from the casting cavities 16 and 16′ when a vacuum is drawn in the chamber 20. The lower portion 10 of the mold 6 may conveniently comprise the same material as the upper portions 8 and 8′, or other materials, permeable or impermeable, which are compatible with the upper portion material.

In accordance with a particularly preferred embodiment of the present invention pieces of angle iron 26 are welded to the inside of the walls 24 of the box 22 so as to provide a continuous, inwardly projecting shelf or lip defining the mouth 18 of the vacuum chamber 20. A continuous, elastomeric gasket 28 (e.g., silicone or fluoroelastomer rubber) is secured (e.g., glued) to the underside of the shelf 26 and is carried thereby for use in the casting of a plurality of molds before replacement. The gasket 28 may be a simple O-ring, but will preferably have a rectangular cross-section for more effective sealing.

The mold 6 will include a sealing surface on an upper surface thereof for engaging the underside of the gasket 28. This surface may be formed anywhere on the upper portion of a mold so long as a continuous surface can be provided. Preferably, however, the lower portion 10 of the mold 6 will include a continuous upstanding ridge 30 having an upper sealing surface 32 for engaging the elastomeric gasket 28 and compressing it against the shelf 26 when the mold 6 is secured to the vacuum box 22. The upstanding ridge 30 on the bottom mold portion 10 lies outboard the porous upper shell portions 8 and 8' so that the upper portions 8 and 8', as well as the parting lines 12 and 12', will confront the vacuum chamber 20 for the reasons set forth in U.S. Ser. No. 654,404. The mold 6 may be secured to the chamber 20 by means of inverted cups 34 which have self-tapping, female threads 35 on the inside surface thereof which are screwed onto upstanding mounting lugs 36 in the manner described in copending U.S. patent application Ser. No. 806,619, filed concurrently herewith in the name of Karl Voss and assigned to the assignee of the present invention.

The walls 24 of vacuum box 22 extend below the angle iron lip 26 of the vacuum chamber 20 so as to form a depending skirt portion 38 thereof. The skirt 38 depends sufficiently beneath the vacuum chamber 20 to surround the gasket 28 and at least the uppermost portion of the ridge 30 to shield the elastomeric gasket 28 from the radiant heat of the melt 4 in the pot 2 during casting. Preferably, the lower edge 40 of the skirt 38 will engage a shoulder 42 on the bottom portion 10 of the mold 6 and serves as a stop means for locating the mold 6 in the vacuum chamber 20. In this regard, the edge 40 abuts the shoulder 42 and prevents overcompression of the gasket 28 and generally insures consistent positioning of each mold in the vacuum box 22.

While the invention has been disclosed primarily in terms of a specific embodiment thereof it is not intended to be limited thereto but rather only to the extent set forth hereafter in the claims which follow.

The embodiments of the invention in which an exclusive property or privilege is claimed are defined as follows:

1. Apparatus for the vacuum countergravity casting of molten metal comprising:

a mold comprising a porous, gas-permeable upper shell at least in part defining a molding cavity and a bottom-gated lower portion secured to said upper shell for admitting said metal into said cavity from an underlying pot of said metal;

a sealing surface atop said mold and thermally remote from the metal in said pot;

a vacuum box defining a vacuum chamber confronting said upper shell for evacuating said cavity through said shell, said box comprising a peripheral wall having a lip on the underside thereof defining a mouth of said chamber;

an elastomeric gasket compressed between the underside of said lip and said sealing surface of said mold for sealing said mold to the mouth of said chamber; and a skirt depending from said box beneath said lip so as to surround said gasket and shield it from heat radiating from said pot.

2. Apparatus for the vacuum countergravity casting of molten metal comprising:

a mold comprising a porous, gas-permeable upper shell at least in part defining a molding cavity and a bottom-gated lower portion secured to said upper shell for admitting said metal into said cavity from an underlying pot of said metal, said lower portion having a continuous upstanding ridge outboard said upper shell and adjacent the periphery of said mod, said ridge having an upper surface which is thermally remote from the metal in said pot;

a vacuum box defining a vacuum chamber enclosing said upper shell for evacuating said cavity through said shell, said box comprising a peripheral wall and having a lip on the underside thereof defining a mouth of said chamber;

an elastomer gasket secured to the underside of said lip for sealingly engaging said upper surface of said ridge; and a skirt depending from said box beneath said lip, said skirt surrounding said gasket and said ridge so as to shield said gasket from heat radiating from said pot.

3. Apparatus for the vacuum countergravity casting of molten metal comprising:

a mold comprising a porous, non-permeable upper shell at least in part defining a molding cavity and a bottom-gated lower portion secured to said upper shell for admitting said metal into said cavity from an underlying pot of said metal, said lower portion having a continuous upstanding ridge outboard said upper shell and adjacent the periphery of said mold, said ridge having an upper surface which is thermally remote from the metal in said pot;

a vacuum box defining a vacuum chamber enclosing said upper shell for evacuating said cavity through said shell, said box comprising a peripheral wall including a lower portior surrounding said ridge and having an edge on the underside thereof defining a mouth of said box for receiving said mold;

a substantially continuous inwardly protecting shelf on the inside of said wall above said edge; and an elastomeric gasket secured to underside of said shelf for sealingly engaging said upper surface of said ridge sufficiently above said edge that said lower portion of said wall shields said gasket from heat radiating from said pot.

* * * * *

UNITED STATES PATENT AND TRADEMARK OFFICE

CERTIFICATE OF CORRECTION

PATENT NO. : 4,616,691

DATED : October 14, 1986

INVENTOR(S) : Karl D. Voss

It is certified that error appears in the above—identified patent and that said Letters Patent is hereby corrected as shown below:

Column 4, line 22, "mod" should read -- mold --.

Column 4, line 37, "non-permeable" should read -- gas-permeable --.

Signed and Sealed this

Seventeenth Day of February, 1987

*Attest:*

DONALD J. QUIGG

*Attesting Officer*

*Commissioner of Patents and Trademarks*